US009062425B2

(12) United States Patent
Schlupp et al.

(10) Patent No.: US 9,062,425 B2
(45) Date of Patent: Jun. 23, 2015

(54) SUPPORT MOUNT FOR LASER-GUIDED ICE RESURFACING MACHINE

(75) Inventors: Andrew John Schlupp, Breslau (CA); Richard Andrew Schlupp, Centre Wellington (CA); Thomas Keith Schlupp, West Montrose (CA)

(73) Assignee: Resurfice Corp., Elmira, Ontario (CA)

( * ) Notice: Subject to any disclaimer, the term of this patent is extended or adjusted under 35 U.S.C. 154(b) by 775 days.

(21) Appl. No.: 12/713,655

(22) Filed: Feb. 26, 2010

(65) Prior Publication Data

US 2011/0213528 A1 Sep. 1, 2011

(51) Int. Cl.
*E01H 4/00* (2006.01)
*E01H 4/02* (2006.01)

(52) U.S. Cl.
CPC ..... *E01H 4/023* (2013.01)

(58) Field of Classification Search
CPC ..... E01H 4/023
USPC ..... 37/196, 219, 221, 234, 236, 270, 271, 37/907; 701/50
See application file for complete search history.

(56) References Cited

U.S. PATENT DOCUMENTS 2,763,939 A 9/1956 Zamboni
4,273,196 A 6/1981 Etsusaki
(Continued)

FOREIGN PATENT DOCUMENTS

CA 2446816 11/2002
EP 0797075 9/1997
(Continued)

OTHER PUBLICATIONS http://en.wikipedia.org/wiki/Ice_resurfacer, accessed Oct. 28, 2009.
(Continued)

*Primary Examiner* — John Q Nguyen
*Assistant Examiner* — Michael Whalen
(74) *Attorney, Agent, or Firm* — Calfee Halter & Griswold, LLP

(57) ABSTRACT

A support mount for a receiver in an ice resurfacing machine, an ice resurfacing machine, a system for making an ice surface level with a desired horizontal plane and its kits of each of them. A receiver is mounted on a support mount for maintaining an ice resurfacing machine level with a desired horizontal plane comprising a mast post that retracts within a structure mounted on the conditioner. The receiver detects a light beam being transmitted along a plane parallel to a desired horizontal plane. The position of the mast post relative to the structure is constrained such that the height of the receiver in a transport position is vertically retracted to permit the ice resurfacing machine to pass under obstacles while entering or leaving an ice surface and in an operative position is extended to a height whereby a light beam emitted by a transmitter along a plane parallel to the desired horizontal plane may be detected. At all times the mast post remains away from contact with the ice surface. Rather, the height of the receiver above the top of the conditioner is maintained constant while in the operative position to permit calibrated and level resurfacing of the ice surface level with the desired horizontal plane.

21 Claims, 6 Drawing Sheets

(56) References Cited

U.S. PATENT DOCUMENTS

| | | | | |
|---|---|---|---|---|
| 4,537,259 | A | 8/1985 | Funabashi | |
| 5,375,663 | A | 12/1994 | Teach | |
| 5,806,604 | A | 9/1998 | Sanders | |
| 5,917,593 | A | 6/1999 | Hirano | |
| 6,029,752 | A * | 2/2000 | Young | 172/4.5 |
| 6,931,874 | B2 | 8/2005 | Dawe | |
| 6,948,267 | B2 * | 9/2005 | Pirila | 37/268 |
| 7,510,247 | B2 * | 3/2009 | Pirila | 299/1.5 |
| 7,850,396 | B2 * | 12/2010 | Pietila et al. | 404/96 |
| 2004/0187357 | A1 * | 9/2004 | Piril | 37/196 |
| 2006/0226695 | A1 * | 10/2006 | Pirila | 299/1.5 |

FOREIGN PATENT DOCUMENTS

| | | |
|---|---|---|
| EP | 1393015 | 3/2004 |
| EP | 1611291 | 1/2006 |
| FI | 20030399 | 9/2004 |
| WO | 02/093106 | 11/2002 |
| WO | 2004/083528 | 9/2004 |

OTHER PUBLICATIONS

Olympia LVR brochure, Jun. 2008.

Olympia LVR Ice Leveling System Instruction Manual, available before Feb. 26, 2010.

* cited by examiner

SUPPORT MOUNT FOR LASER-GUIDED ICE RESURFACING MACHINE

TECHNICAL FIELD

The present disclosure relates to ice resurfacing machines and more particularly, a support mount for laser-guided ice resurfacing machines.

INTRODUCTION

Laser leveling devices have been employed to provide precise calibration of elevations and to ensure correction of minute disparities in level for technologies ranging from hanging framed pictures to earth moving machines. In these technologies, a laser beam is dispersed about a region in a level plane and the position of a device, such as a picture frame or a bumper plate of a bulldozer is adjusted in accordance with a reading from the laser beam.

Such technology has been employed in ice resurfacing machines to maintain an ice surface level along a desired horizontal plane. In U.S. Pat. No. 6,948,267 issued Sep. 27, 2005 to Pirila, a system for performing maintenance on an ice surface of an ice hockey rink was disclosed, comprising an ice resurfacing machine movable across the ice surface and comprising a scraper blade which scrapes the ice surface, a laser transmitter which transmits a laser beam and a laser control unit mounted on the ice resurfacing machine, the laser control unit comprising a laser receiver which receives the laser beam transmitted by the laser transmitter and an elongated member operatively associated with the laser receiver and mounted on the ice resurfacing machine in a freely movable manner, the elongated member having a lower end adapted to rest on the ice surface as the ice resurfacing machine move[s] across the ice, the laser control unit being operatively connected to the scraper blade to adjust an elevation of the scraper blade. Pirila disclosed a free-sliding fixed length measuring rod fit inside an upright tubular frame part, with a runner extending from the bottom end of the measuring rod that presses against the ice surface and a laser receiver mounted on the top end of the measuring rod, which extends above the top of the ice resurfacing machine.

This arrangement poses a number of problems. First, most groomed ice arenas feature vertical dasher boards extending substantially vertically between substantially 40 inches and 48 inches and a series of glass or acrylic panels extending substantially about 4 feet above the dasher boards substantially or completely surrounding the periphery of the ice surface, with an ice dam extending substantially vertically substantially about a few inches above the ice surface. Thus, when travelling up over the ice dam to exit the ice surface through an opening in the dasher boards, the free-sliding measuring rod trailing behind will not rise with the resurfacing machine, may catch the ice dam and may be damaged or taken out of alignment. Further, in many ice hockey arenas, to prevent pucks and other objects from leaving the ice surface, a series of nets and other obstacles may extend downward from a suspended line down to the dasher boards and glass. While an opening is typically formed within the netting to permit the ice resurfacing machine to pass through the opening when entering or exiting the ice surface, the laser receiver extending above the machine may catch the netting, again leading to damage or lack of calibration.

BRIEF DESCRIPTION OF THE DRAWINGS

Like reference numerals are used in the drawings to denote like elements and features.

DESCRIPTION

The present disclosure provides example embodiments of an ice resurfacing machine with a support mount for a receiver, the support mount itself, a system comprising the ice resurfacing machine and transmitter and kits of such machines and systems.

Figure 1:
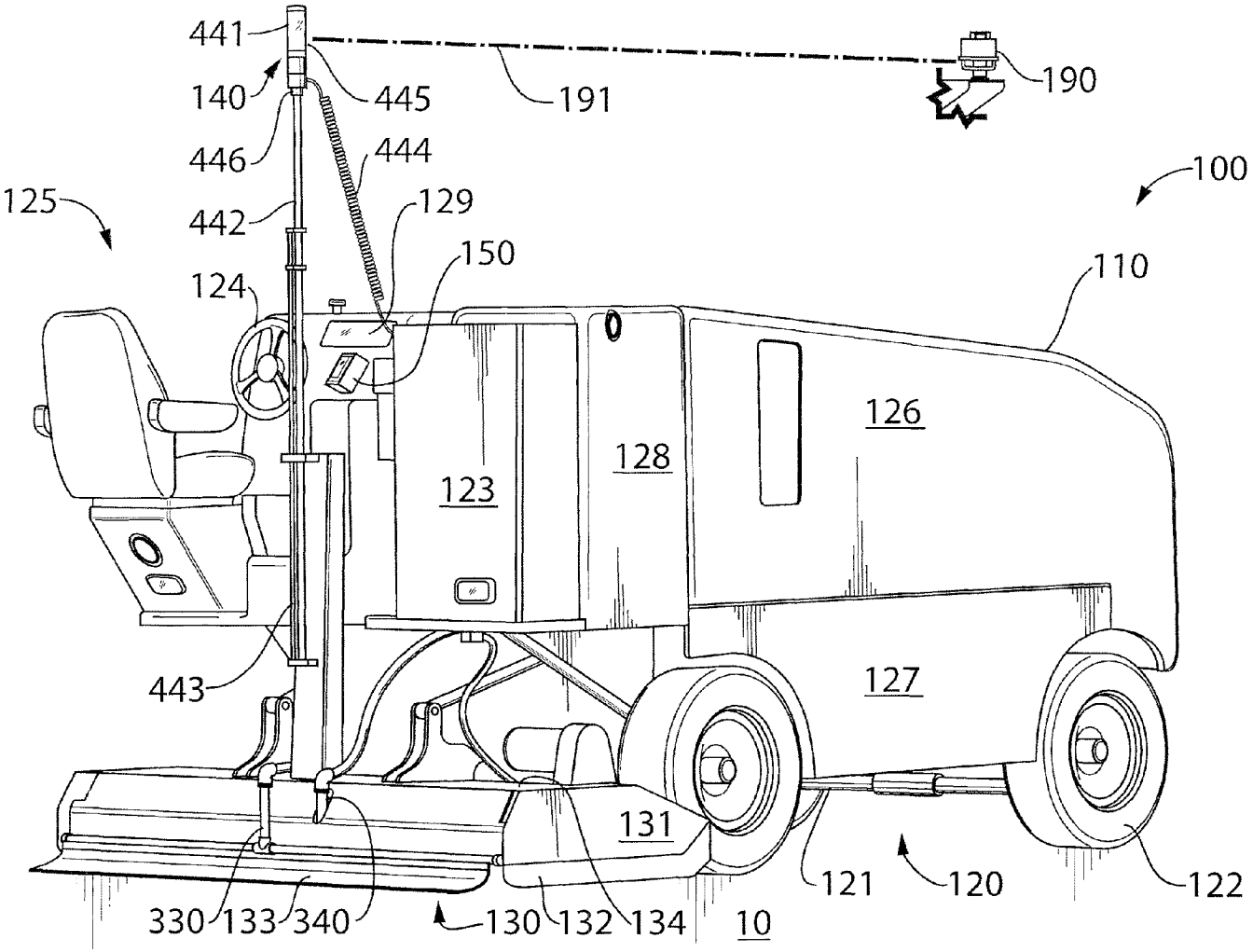
FIG. 1 is a right side perspective view illustrating an ice resurfacing machine with a support mount for the receiver in accordance with one example embodiment of the present disclosure.

Reference is now made to FIG. 1, which illustrates a system for resurfacing an ice surface 10 to remain level along a desired horizontal plane. The system 100 comprises an ice resurfacing machine 110 and a transmitter 190. The ice resurfacing machine 110 comprises a vehicle 120, a conditioner 130, a receiver 140 and a control unit 150.

Figure 2:
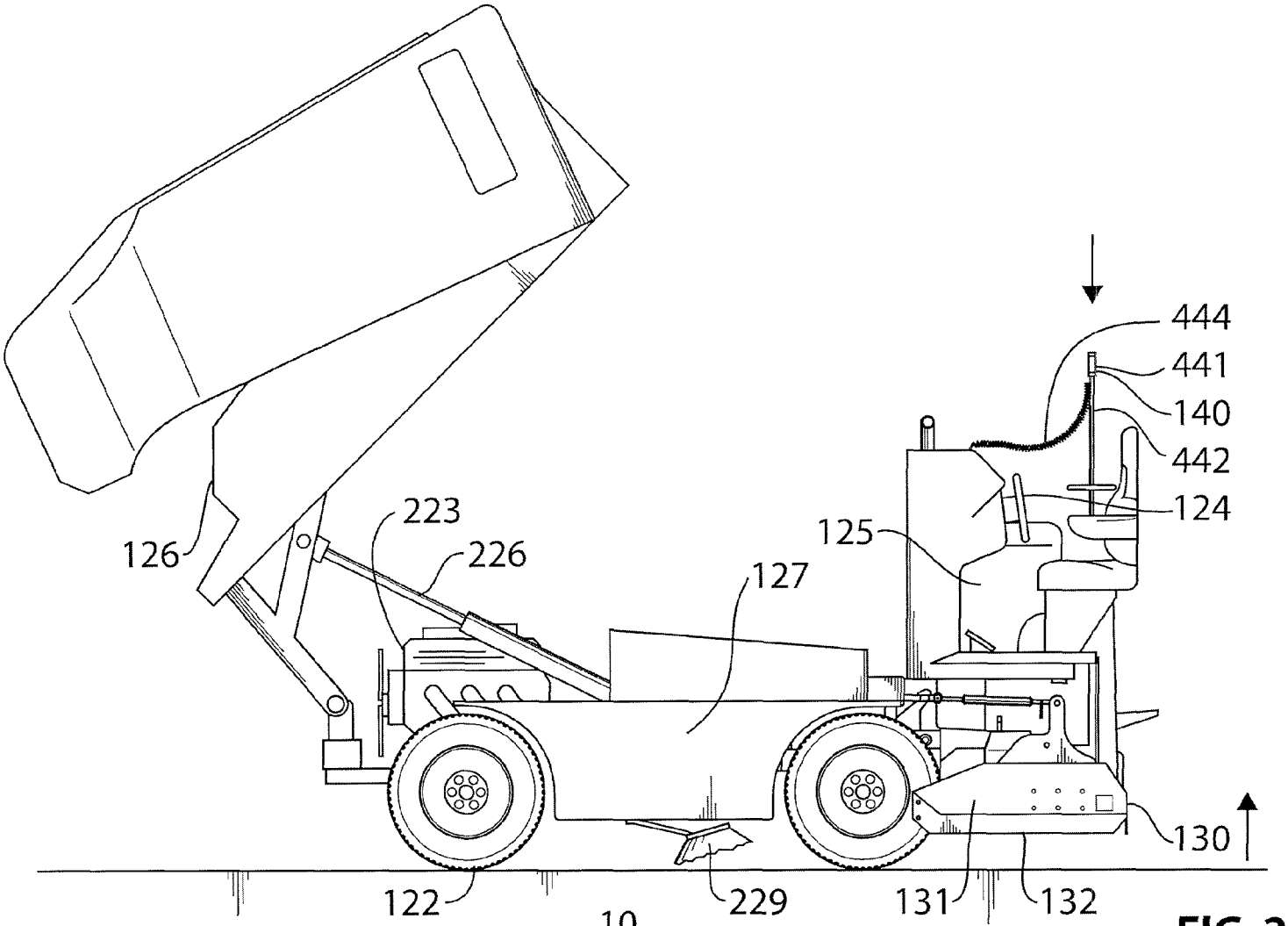
FIG. 2 is a left side view of the ice resurfacing machine of FIG. 1, with the bin extended and the conditioner retracted.

The vehicle 120 comprises a chassis 121 that may be moved around the ice surface 10. In some example embodiments, the vehicle 120 may comprise a plurality of wheels 122, tracks, skis or the like to facilitate movement of the chassis 121. In some example embodiments, the wheels 122 are fitted with tires having carbide-tipped tire studs to provide increased traction across the ice surface 10. In some example embodiments, the vehicle 120 is self-propelled, for example by natural gas, propane, electricity or gasoline powering an engine 223 (FIG. 2) or motor that provides propulsion, which in some example embodiments, may be a four-wheel drive transmission, and hydraulic power to other components of the ice resurfacing machine 110. In some example embodiments, the fuel may be stored in fuel tanks 323 (FIG. 3), which may be internal to the chassis 121 or externally mounted on the chassis 121. In some example embodiments, the vehicle 120 is operator-controlled. In some example embodiments, the vehicle 120 may be steered using a steering mechanism 124.

In some example embodiments, the steering mechanism 124 is situated in or accessible at a cab area 125 of the chassis 121. In some example embodiments, the cab area 125 houses the control unit 150 and other controls 129 for effecting the resurfacing of the ice surface 10. In some example embodiments, the steering mechanism 124 is operator-accessible in the cab area 125. In some example embodiments the cab area 125 is positioned on the left side of the chassis 121 (i.e. left hand drive), so as to facilitate travel in a typical clockwise direction by providing good visibility of the ice dam and dasher boards on a left side of the vehicle 120.

In some example embodiments, the vehicle 120 may comprise a dump tank 126 for collecting scraped up snow and ice shavings prior to applying a resurfacing fluid to the ice surface 10. In some example embodiments, the dump tank 126 may be interior to the chassis 121 and accessible to the conditioner 130. As may be better seen in FIG. 2, the dump tank 126 may be extendable as by hydraulic lifts 226 to allow rapid disposal of the scraped up snow and ice shavings after resurfacing is complete.

In some example embodiments, the vehicle 120 may comprise a main reservoir 127 for storing filtered and/or treated water or other resurfacing fluid prior to be dispensed through the conditioner 130 onto the ice surface 10. In some example embodiments, the resurfacing fluid may be heated to substantially between 140° F. and 160° F. In some example embodiments, the resurfacing fluid may be pre-heated prior to storage in the main reservoir 127. In some example embodiments, the main reservoir 127 may comprise a heating element (not shown) for heating the resurfacing fluid. In some example embodiments the main reservoir 127 may be insulated to retain the resurfacing fluid at a given temperature.

In some example embodiments, the vehicle 120 may comprise an ancillary reservoir 128 for storing unheated wash water or other fluid. The conditioner 130 sprays the wash water on the ice surface 10 and vacuums it up, together with any foreign material that may otherwise become embedded in the ice surface 10. In addition to gathering up foreign material, the application of wash water on the snow lying on the ice surface 10 serves to produce a slush or slurry which may be forced by the conditioner 130 against the ice surface 10 when scraping to fill holes or gouges, prior to dispensing the resurfacing fluid across the ice surface 10. In some example embodiments, the recovered wash water is filtered through a screen (not shown) and recirculated back into the ancillary reservoir 128 to be re-used.

In some example embodiments, the vehicle 120 may comprise at least one retractable board brush 229 (FIG. 2) which may be deployed when the vehicle 120 is moving proximate to the dasher boards, for brushing loose snow and ice that may have accumulated along the ice dam below the dasher boards to be gathered up by the conditioner 130. Typically, ice resurfacing machines travel in a clockwise direction because the vehicle 120 is typically left hand drive. As a result, in some example embodiments, the board brush 229 is positioned on the left side of the vehicle 120 only.

The conditioner 130 performs resurfacing of the ice surface 10 to maintain its level along the desired horizontal plane as it is passed over by the vehicle 120. In some example embodiments, the conditioner 130 is positioned on or above the ice surface 10 at the rear of the vehicle 120 (relative to its direction of travel). In some example embodiments, the conditioner 130 extends substantially across the width of the vehicle 120. In some example embodiments the conditioner 130 defines an enclosed space, bounded by side plates 131 and runners 132 at the sides, a squeegee 133 or a towel or both at the rear and one or more cover panels 134 on the top.

Figure 3:
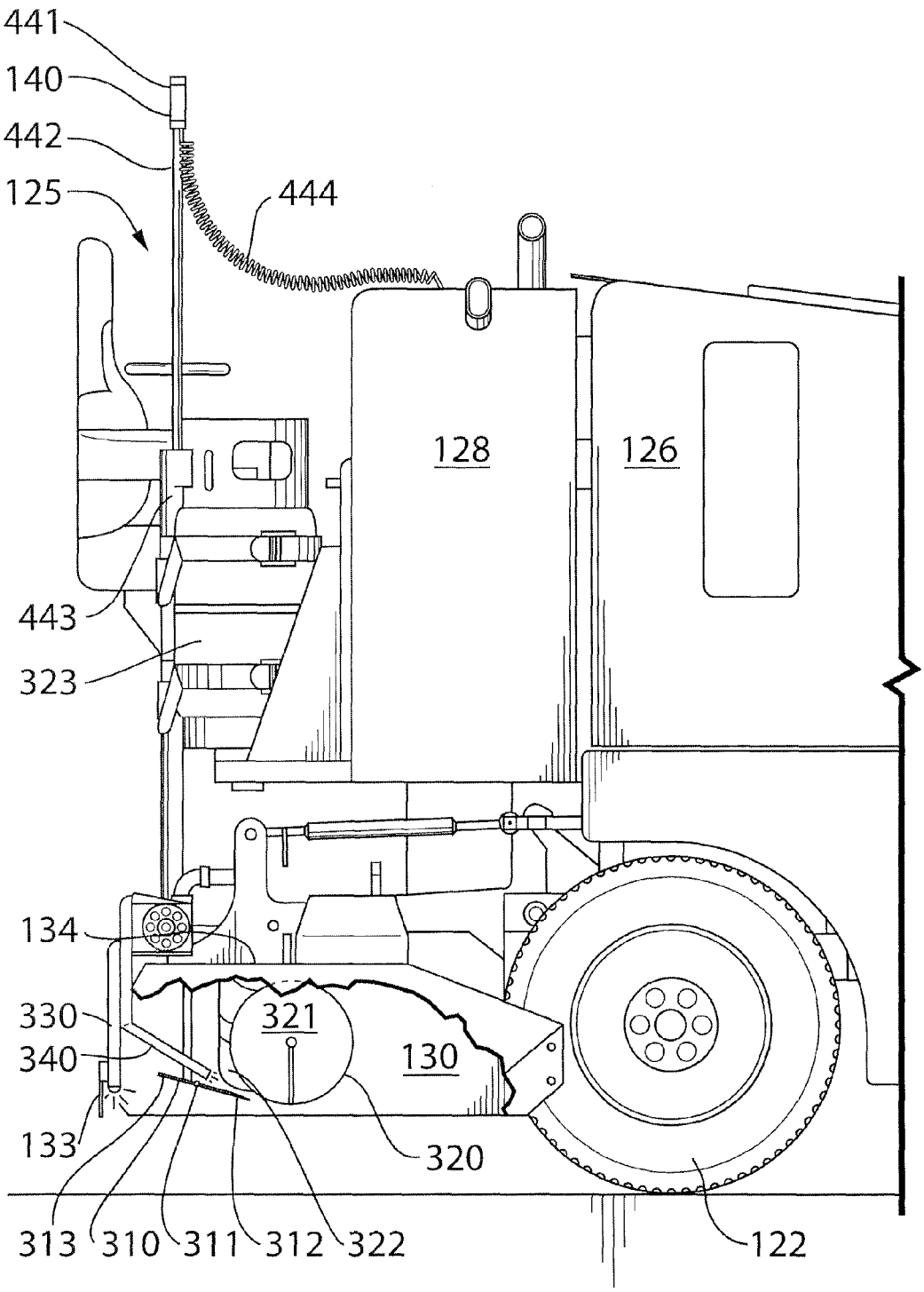
FIG. 3 is an expanded right side view of a rear portion of the ice resurfacing machine of FIG. 1, with the right side plate and runner of the conditioner and cabinet removed for illustrative purposes.

FIG. 3 shows an expanded right side view of the conditioner 130 with the right side plate 131, runner 132 and cabinet 123 removed for illustrative purposes. In order to facilitate entry onto and exit from the ice surface 10 over the ice dam, the conditioner 130 may be raised. As indicated by the upward-pointing arrow in FIG. 2, in some example embodiments, the conditioner 130 may be raised by a height of up to substantially 9 inches. In some example embodiments, the height of the conditioner 130 may be varied using operator-controlled and calibrated hydraulic lifts (not shown) in a manner in which the conditioner 130 above may be consistently lowered to the ice surface 10 for ice resurfacing operations, so that the cover panels 134 may be at a constant known height above the ice surface 10. The height of the cover panels 134 above the ice surface 10 remains constant during ice resurfacing operations. In some example embodiments, the cover panels 134 may be substantially 12 inches above the ice surface 10 when the conditioner 130 is lowered to the ice surface 10 for ice resurfacing operations.

The conditioner 130 comprises, within the enclosed space, a scraper blade 310, an auger assembly 320 and at least one fluid dispenser 330, 340. In some example embodiments, the scraper blade 310 and auger assembly 320 may be activated independently of the fluid dispensers 330, 340 or either of them or the fluid dispensers 330, 340 or either of them may be activated independently of the scraper blade 310 and auger assembly 320. In some example embodiments, the scraper blade 310 and auger assembly 320 and the fluid dispensers 330, 340 or either of them may be simultaneously activated.

The scraper blade 310 removes a top thickness of ice surface 10 and any debris and snow lying on it to maintain the ice surface along the desired horizontal plane. In some example embodiments the scraper blade 310 extends substantially across the width of the conditioner 130. In some example embodiments, the scraper blade 310 comprises a single blade sharpened at 27° and mounted at an angle between 8° and 10° from the ice surface. In some example embodiments, the scraper blade 310 is pivotable about a tilt axle 311 running across the width of the conditioner 130 and extending substantially through a middle portion of the scraper blade 310. A sharpened blade edge 312 engages the ice surface 10 in front of the tilt axle 311 and removes the top thickness of the ice surface 10. The depth of cut made by the blade edge 312 may be adjusted by raising or lowering a back surface 313 of the scraper blade 310 on the opposite side of the tilt axle 311 from the blade edge 312.

The back surface 313 is driven by a lead screw (not shown) to extend the back surface 313 upward or downward in a calibrated manner. As the lead screw (not shown) is rotated in one direction, the back surface 313 is raised and the blade edge 312 is lowered, permitting a deeper cut. As the lead screw (not shown) is rotated in an opposite direction, the back surface 313 is lowered and the blade edge 312 is raised, reducing the depth of cut by the scraper blade 310. In some example embodiments, the depth of the top thickness removed by the blade edge 312 is controllable within a precision of substantially 0.05 mm and may vary between 0.5 mm and 5 mm.

The auger assembly 320 gathers the ice, snow and debris removed by the scraper blade 310 from the ice surface 10 and transports it to the dump tank 126 for storage. In some example embodiments, the auger assembly 320 comprises at least one lower horizontal auger 321 and a vertical auger 322.

The horizontal auger 321 is positioned directly in front of the blade edge 312 of the scraper blade 310 and channels the ice, snow and debris removed by the scraper blade 310 to a common location (not shown), which in some example embodiments is centrally disposed within the conditioner 130.

The vertical auger 322 gathers the channeled ice, snow and debris at the common location and transports it upward, allowing it to be disposed of through an opening onto the dump tank 126 using snow blower style paddles at the top of and attached to the vertical auger 322.

The main fluid dispenser 330 draws resurfacing fluid from the main reservoir 127 and disseminates it across the freshly scraped ice surface 10. In some example embodiments, the main fluid dispenser 330 may comprise a pump (not shown) and tube extending from the main reservoir 127 and terminating at a sprinkler pipe 134 (FIG. 1) extending laterally substantially the width of the conditioner 130, with evenly distributed holes or outlets for distributing the resurfacing fluid across the ice surface 10 in behind of the squeegee 133 in the wake of the ice resurfacing machine 100. The resurfacing fluid fills any residual grooves to form a new ice surface 10. In some example embodiments, the resurfacing fluid is heated to between substantially 140° F. to 160° F. to melt and smooth the top layer of ice. In some example embodiments, the resurfacing fluid comprises filtered and treated water, with no minerals or chemicals which may adversely affect the quality, appearance or odour of the ice surface 10. The towel 133 works with the side plates 131 and runners 132 to constrain the extent of flow of the resurfacing fluid to substantially the footprint of the conditioner 130. Additionally, the squeegee 133 serves to further distribute the resurfacing fluid across the ice surface 10 and to minimize pooling or puddling of resurfacing fluid and to promote smooth and rapid refreezing of the ice surface 10.

In some example embodiments, the fluid dispensing rate of the main fluid dispenser 330 is operator-controllable. In some example embodiments, the main fluid dispenser 330 is positioned to distribute resurfacing fluid behind the conditioner 130 (relative to the direction of travel) on the ice surface 10. In some example embodiments, the main fluid dispenser 330 comprises a heater for heating the resurfacing fluid prior to being dispensed.

In some example embodiments, a second fluid dispenser 340 draws cold wash water from the ancillary reservoir 128 and sprays it on the ice surface 10 behind the blade edge 312 of the scraper blade 310. In some example embodiments, the second fluid dispenser 340 comprises a spray nozzle at one or both ends of the conditioner 130. The wash water interacts with snow and remnants of shaved ice to provide a slush or slurry which may assist in filling holes cracks in the ice surface 10. Additionally, the wash water is retrieved by a vacuum nozzle (not shown) in the conditioner 130, in front of the squeegee 133, and filtered through a basket-style screen (not shown) and recirculated back into the ancillary reservoir 128 to gather up and remove foreign material which might otherwise become embedded in the ice surface 10.

Figure 4:
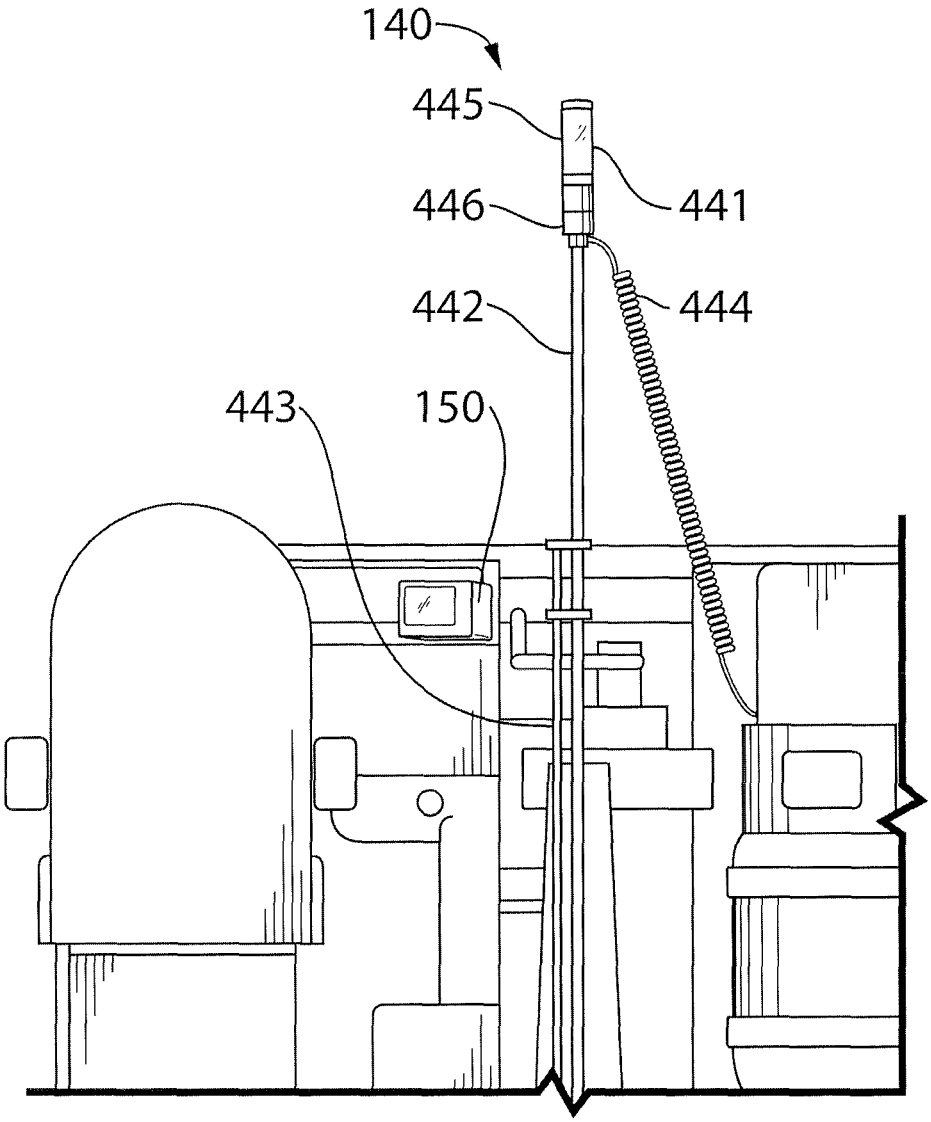
FIG. 4 is a rear perspective view of a cab area of the ice resurfacing machine of FIG. 1, showing a receiver according to an example embodiment of the present disclosure.

Turning now to FIG. 4, the receiver 140 comprises a receiver unit 441, an extendable mast pole 442, a support mount 443, and a cable 444. In some example embodiments, the receiver unit 441 is a cylindrical laser receiver with a receiving window 445. In some example embodiments, the receiving window 445 may extend entirely around the receiver unit 441 and may be substantially 4 inches in height. When a light beam 191 (FIG. 1), transmitted along a plane parallel to the desired horizontal plane of the ice surface 10, impinges on the receiving window 445, the position along the height of the receiving window 445 is determined by the receiver unit 445 and forwarded to the control unit 150 along the cable 444. In some example embodiments, the accuracy of the position, along the height of the receiving window 445, at which the light beam 191 impinges, may be determined to an accuracy of ±0.05 mm.

In some example embodiments, the receiver unit 441 may comprise a base 446 for engaging a top end of the mast pole 442 while permitting it to safely break away from the mast pole 442 if the receiver unit 445 comes into contact with an obstacle. In some example embodiments, the base 446 may be composed of or comprise a magnet. In some example embodiments, the base 446 may be composed of or comprise a ferro-magnetic metal. In some example embodiments, the receiver unit 445 remains tethered to the ice resurfacing machine 100 even when after breaking away from the mast pole 442 through the cable 444.

In some example embodiments, the receiver unit 441 may be a receiver unit manufactured by Latec Instruments Inc. of Exeter, Ontario Canada.

The mast pole 442 is a substantially vertically oriented rod adapted to engage the base 446 of the receiver unit 441 at a top end. In some example embodiments, the mast pole 442 may be adjusted to match substantially the height of the transmitter 190. In some example embodiments, the top end of the mast pole 442 may be fitted to securely accept the base 446 thereon. In some example embodiments, the mast pole 442 may be composed of or comprise a magnet. In some example embodiments, the mast pole 442 may be composed of or comprise a ferro-magnetic metal.

A bottom end of the mast pole 442 is extendably inserted within a bore in the support mount 443 or otherwise secured to the ice resurfacing machine 100. The bottom end of the mast pole 442 lies on or above the cover panels 134 of the conditioner 130 and away from contact with the ice surface 10. The mast pole 442 may be raised and lowered relative to a top surface of the support mount 443 to elevate or retract the receiver unit 441 in a controlled and calibrated manner. In some example embodiments, the mast pole 442 may be hydraulically raised and lowered. In some example embodiments, the top end of the mast pole 442 is raised to a predetermined operative height and lowered as indicated by the downward-pointing arrow in FIG. 2, to a predetermined transport height. In some example embodiments, the operative height, which, in some example embodiments may be 122 inches above the cover panels 134 of the conditioner 130, is selected to maintain the receiver at a constant height above the ice surface when the conditioner 130 is travelling along the ice surface 10 such as during ice resurfacing operations to ensure that the receiving window 445 of the receiver unit 441 is in an operative position to engage the light beam 191 emitted by the transmitter 190. In some example embodiments, the transport height, which in some example embodiments may be 68 inches above the cover panels 134 of the conditioner 130, is selected to ensure that the receiver unit 441 may be retracted to a transport position that allows it to pass under any obstruction, such as an overhanging net, when entering or exiting the ice surface 10 through an opening in the dasher boards with the conditioner 130 raised.

The support mount 443 is a structure that accommodates the mast pole 442 within an internal substantially vertical bore or otherwise secures the bottom end of the mast pole 442 to the ice resurfacing machine 100. In some example embodiments, the support mount 443 comprises a cylindrical tube sized to accommodate the mast pole 442 within it and mounted on an existing structure positioned on the conditioner 130. In some example embodiments, the support mount 443 may be integral to such existing structure positioned on the conditioner 130.

The support mount 443 comprises a mechanism (not shown), which in some example embodiments, is hydraulically driven, to raise or lower a bottom end of the mast pole 442 within the internal bore of the support mount 443, so as to move the receiver unit 441 between the operative and transport positions. In some example embodiments, the extension and contraction of the mast pole 442 is coordinated and simultaneous with the lowering and raising of the conditioner 130.

Thus, when the conditioner 130 is raised to facilitate entry to and exit from the ice surface through an opening in the dasher boards above the ice dam, the receiver unit 441 may be simultaneously retracted from the operative position to the transport position to avoid any contact between the receiver unit 441 and any overhanging obstacles such as nets. Similarly, when on the ice surface 10, the conditioner 130 is lowered to the ice surface 10 to begin resurfacing operations, the receiver unit 441 is simultaneously extended from the transport position to the operative position in order to begin detecting the light beam 191 generated by the transmitter 190 in order to ensure that performance of the resurfacing operation results in a substantially smooth and level ice surface 10.

While the mast pole 442 is at all times away from contact with the ice surface 10, a level ice surface 10 may be obtained because the support mount 443 maintains the receiver 140 at a constant height above the ice surface in the operative position during ice resurfacing operations since the height of the receiver unit 441 relative to the cover panels 134 of the conditioner 130 is known and the height of the cover panels 134 of the conditioner 130 relative to the ice surface 10 is also known when the receiver unit 441 is in the operative position.

Figure 5:
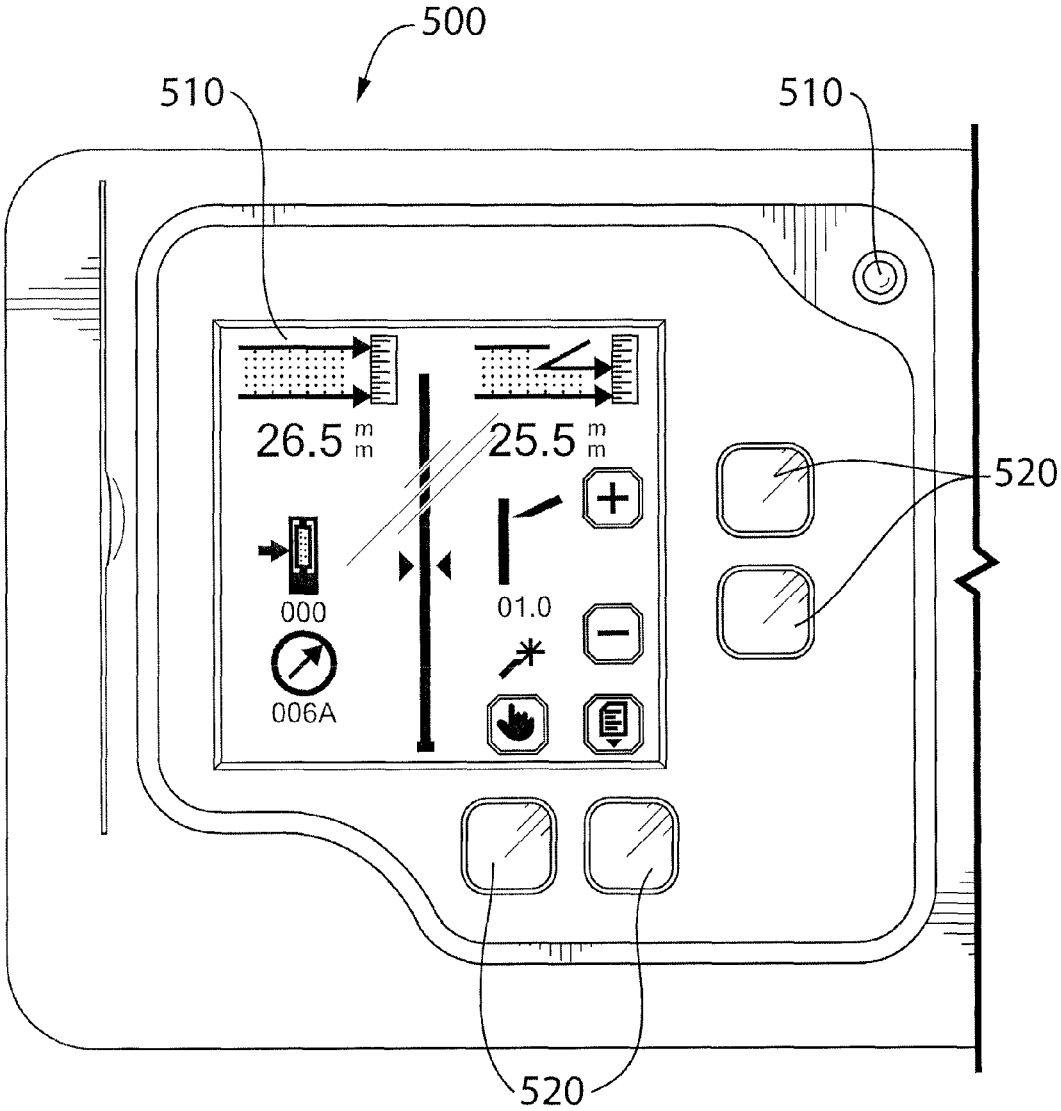
FIG. 5 is an enlarged view of an example embodiment of a control processor of a control unit of the ice resurfacing machine of FIG. 1.

The control unit 150 comprises a control processor 500 and a blade drive 600. As shown in greater detail in FIG. 5, the control processor 500 comprises one or more output elements 510 such as a screen and indicators, one or more input elements 520 such as buttons, and an internal processor (not shown). The control processor 500 accepts inputs from the receiver 140 along cable 440 indicative of the position along the height of the receiving window 445 where the light beam 191 emitted by the transmitter 190 is detected along the plane parallel to the desired horizontal plane, which indicates a relative height of the ice surface 10 immediately beneath the conditioner 130. In some example embodiments, the position is specified to an accuracy of substantially ±0.05 mm. The control processor 500 communicates servo information to the blade drive 600 through a servo cable 610 (FIG. 6) to control the depth of cut made by the edge 312 of the scraper blade 310. In some example embodiments, the servo information specifies a depth of cut to an accuracy of substantially ±0.05 mm.

The control processor 500 maintains and displays certain system information including ice elevation, ice set points and the depth of ice being cut. It permits entry of system parameters for performing system calibration, including calibration of the receiver unit 441, the scraping blade 310 and blade travel limits. In some example embodiments, such system information may be graphically displayed on the output elements 510 permitting real-time monitoring of the ice resurfacing operations. The system parameters permit the specification of a desired ice thickness over the highest point on the ice surface 10 to configure the laser control unit 150 under direction of the control processor 500 to manage the ice resurfacing operation to maintain that the ice surface 10 level along the desired horizontal plane to an accuracy of, in some example embodiments, substantially ±0.05 mm.

Figure 6:
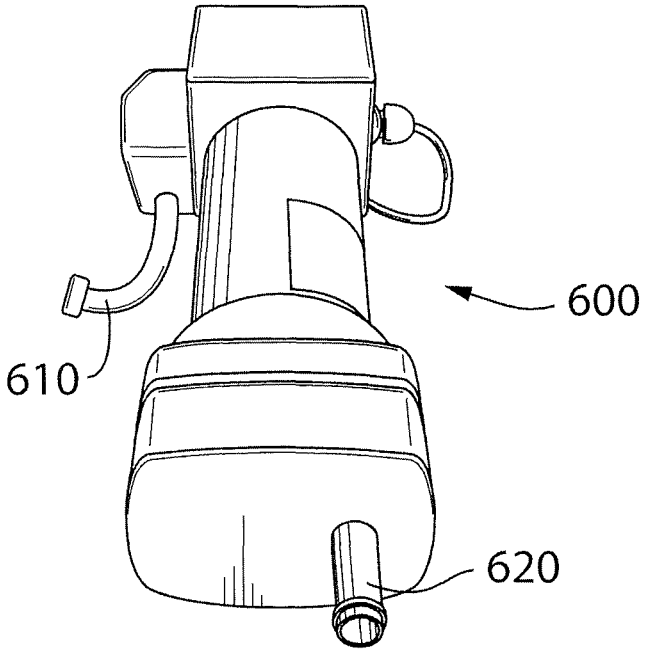
FIG. 6 is a perspective view of an example embodiment of a blade drive of the control unit of the ice resurfacing machine of FIG. 1.

As shown in FIG. 6, the blade drive 600 is an electric drive system controlled by the control processor 500 by servo signals sent by the control processor 500 to the blade drive 600 along servo cable 610. An output 620 of the blade drive 600 rotates the lead screw (not shown) to adjust the cutting height of the blade edge 312 of the scraper blade 310 and control the depth of cut. In some example embodiments, a change in cutting height of the blade edge 312 of substantially 0.05 mm corresponds to a substantially 45° turn of the lead screw (not shown).

Figure 7:
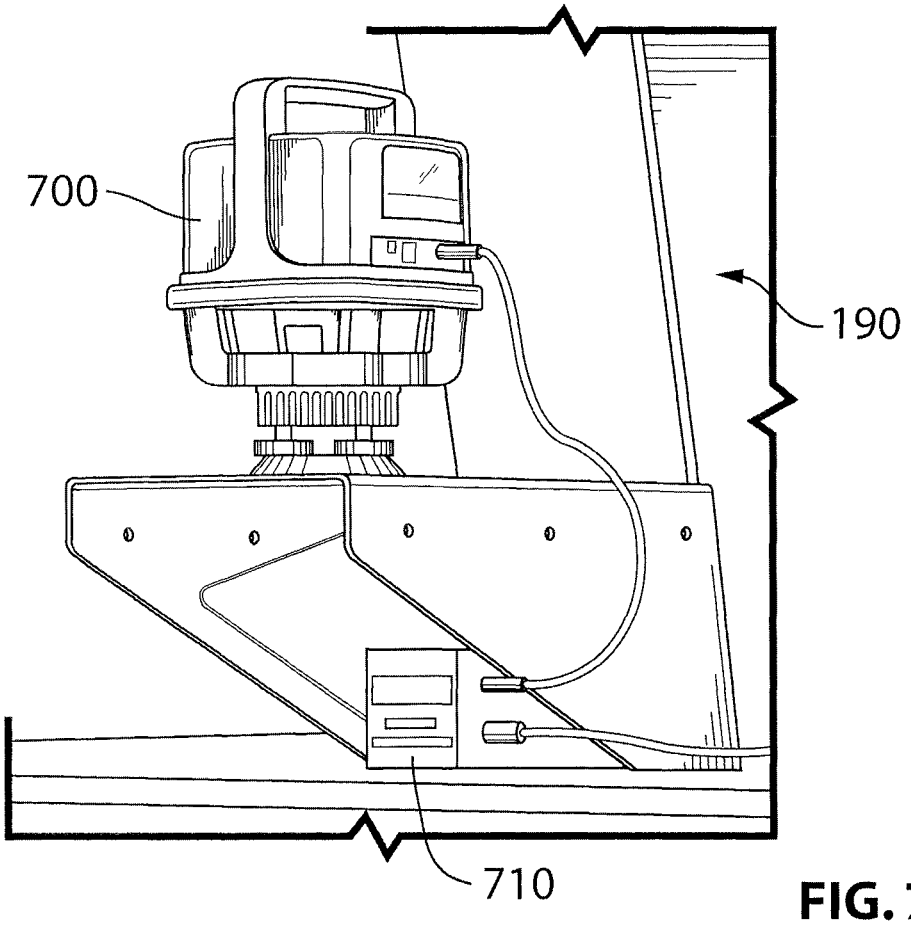
FIG. 7 is a perspective view of an example embodiment of a transmitter for use with the ice resurfacing machine of FIG. 1.

As is shown in FIG. 7, the transmitter 190 comprises a laser emitter 700. In some example embodiments, the transmitter 190 further comprises a wireless remote power switch 710.

The laser emitter 700 emits a beam of light 191 outward from the emitter 700 in a planar pattern parallel to the desired horizontal plane, across a field of view that may, in some example embodiments, be substantially 360° or a portion thereof. In some example embodiments, the light beam 191 may be a laser beam. In some example embodiments, the light beam 191 may be emitted across the entire field of view simultaneously, or in a determinate pattern (for example, in a rotating or oscillating scanning beam pattern across the field of view). The laser emitter 700 is mounted above (for both) the ice surface 10 in a position and orientation such that the planar beam pattern is level and parallel to the descending horizontal plane and covers substantially the entire ice surface 10 any portion on the ice surface 10 over which the receiver 140 mounted on the ice resurfacing machine 100 passes. In some example embodiments, the laser emitter 700 is mounted on a pole or tripod fastened or situated on a floor or other structure at a point beyond the extent of the ice surface 10. In some example embodiments, the laser emitter 700 is rigidly mounted on a wall or suspended from a ceiling surrounding the ice surface 10.

The remote power switch 710 may be interposed between the laser emitter 700 and a power source (not shown). It permits the supply of power to the laser emitter 700 to be controlled wirelessly from the control processor 500, so as to achieve power savings by interrupting the supply of power to the laser emitter 700 when the ice resurfacing machine 100 is not in use for resurfacing the ice surface 10. Additionally, because laser beams, even low power laser beams are generally considered to be a potential hazard if directed into the eyes or applied to the body of a person, the use of the remote power switch 710 minimizes the emission of the light beam 191 to those times when ice resurfacing operations are in effect.

In operation, prior to the commencement of ice resurfacing operations, the ice resurfacing machine 100 may be stored at a location remote from but accessible to the ice surface 10. The conditioner 130 may be in a raised position and the receiver unit 441 may concomitantly be in the transport or retracted position.

By the time ice resurfacing operations are to commence, the main reservoir 127 and the ancillary reservoir 128 have been filled with heated resurfacing fluid and cold wash water respectively, and the dump tank 126 has been emptied. The ice resurfacing machine 100 may then be driven or otherwise transported to the ice surface 10 through an opening in the dasher boards. Because the conditioner 130 is raised, it will not contact the ice dam as the ice resurfacing machine 100 descends to the ice surface 10 across the ice dam. Because the receiver unit 441 is retracted, it will not contact any obstacle such as overhanging netting as the ice resurfacing machine 100 passes through the opening in the dasher boards.

Once in position on the ice surface 10, the conditioner 130 may be lowered to the ice surface 10, concomitantly extending the receiver unit 441 to the operative position so that the receiver unit 441 is maintained by the support mount 443 at a constant height above the ice surface 10 at a point immediately beneath the conditioner 130. If not already done so, the laser emitter 700 may be activated, for example, remotely from the control processor 500 using the remote power switch 710, so that the light beam 191 is emitted along a plane parallel to the desired horizontal plane across substantially the entirety of the ice surface 10.

Once the system parameters and the desired height of the ice surface 10 has been specified using the display elements 510 and the input elements 520, which may have been previously effected prior to commencement of ice resurfacing operations, the ice resurfacing machine 100 may be directed around the ice surface 10 in any desired pattern, including randomly or in a typical clockwise overlapping pattern for ice resurfacing operations.

The receiver unit 441 detects the light beam 191 and determines the position along the height of the receiving window 445 at which the light beam 191 impinges it and communicates information corresponding to this position to the control processor 500.

The control processor 500, armed with this information, the system parameters and the desired height of the desired horizontal plane of the ice surface 10, and in view of the fact that the height of the receiver unit 441 above the cover panels 134 of the conditioner 130 and the height of the cover panels 134 of the conditioner 130 above the ice surface 10 remains substantially constant whenever the conditioner 130 is lowered to the ice surface 10 and the receiver unit 441 is extended in an operative position during an ice resurfacing operation, the control processor 500 issues servo signals to the blade drive 600 to rotate the lead screw in a direction and to an extent to raise or lower, as the case may be, the blade edge 312 of the scraper blade 310 to remove ice beneath the conditioner 130 in order to maintain the level of the ice surface 10 at the desired horizontal plane or to approach it, to a precision limit of the receiver 140, which may be substantially 0.05 mm in some example embodiments.

As the ice resurfacing machine 100 moves along the ice surface 10, the height of the receiver unit 441 relative to the level plane defined by the light beam 191 emitted by the laser emitter 700 may increase or decrease corresponding to an increase in the height of the ice surface 10 over which the conditioner 130 is passing. This information is provided to the control processor 500, which can alter the servo signals it transmits to the blade unit 600 correspondingly.

While a change to the depth of cut communicated by the control processor 500 to the blade drive 700 may result in a delay before the depth of cut by the edge 312 is correspondingly altered, the relative slow speed of travel of the ice resurfacing machine 100 ensures that such delays will not significantly affect the ability of the ice resurfacing machine 100 to create a substantially smooth ice surface 10 that is level with the desired horizontal plane. Even if there are significant local variations in level of the ice surface 10, calling for significant changes in depth of cut over a small distance, a substantially smooth ice surface 10 that is level with the desired horizontal plane may be obtained using the ice resurfacing machine 100, having regard to the amount of overlap between consecutive passes of the ice resurfacing machine 100 during a single resurfacing operation and the fact that the same ice surface 10 is being resurfaced over and over again. In some example embodiments, ice time is rented out in 1 hour intervals, so that if resurfacing is performed between each rental period, a relatively large number of resurfacing operations will be effected over the course of a single day.

While the present disclosure is sometimes described in terms of methods, the present disclosure may be understood to be also directed to various apparatus including components for performing at least some of the aspects and features of the described methods. Moreover, an article of manufacture for use with the apparatus may direct an apparatus to facilitate the practice of the described methods. Such apparatus and articles of manufacture also come within the scope of the present disclosure.

The various embodiments presented herein are merely examples and are in no way meant to limit the scope of this disclosure. Variations of the innovations described herein will become apparent from consideration of this disclosure and such variations are within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combination will become readily apparent upon review of the present disclosure as a whole. The subject matter described herein and in the recited claims intends to cover and embrace all suitable changes in the technology.

According to a first broad aspect of the present disclosure, there is disclosed a support mount for maintaining a receiver on an ice resurfacing machine for maintaining an ice surface level with a desired horizontal plane, the support mount for maintaining the receiver in an operative position at a constant height above the ice surface during ice resurfacing operations, the receiver for detecting a light beam emitted along a plane parallel to the desired horizontal plane and for determining a substantially vertical position along the receiver where the light beam impinges it, the ice resurfacing machine movable across the ice surface and comprising: an adjustable scraper blade for removing a depth of ice from the ice surface; a mast pole having a top end for supporting the receiver and a bottom end secured to the scraper blade; and a processor operatively coupled to the receiver and the scraper blade for determining the depth of ice to be removed based on the position along the receiver where the light beam impinges it and the level of the desired horizontal plane and for adjusting the scraper blade to remove ice to the depth determined.

According to a second broad aspect of the present disclosure, there is disclosed an ice resurfacing machine movable across an ice surface for maintaining the ice surface level with a desired horizontal plane, comprising: a receiver for detecting a light beam emitted along a plane parallel to the desired horizontal plane and for determining a substantially vertical position along the receiver where the light beam impinges it; a support mount for maintaining the receiver at a constant height above the ice surface during ice resurfacing operations; an adjustable scraper blade for removing a depth of ice from the ice surface; a mast pole having a top end for supporting the receiver and a bottom end secured to the scraper blade; and a processor operatively coupled to the receiver and the scraper blade for determining the depth of ice to be removed based on the position along the receiver where the light beam impinges it and the level of the desired horizontal plane and for adjusting the scraper blade to remove ice to the depth determined.

According to a third broad aspect of the present disclosure, there is disclosed a system for maintaining an ice surface level with a desired horizontal plane comprising: a transmitter for emitting a light beam along a plane parallel to the desired plane; and an ice resurfacing machine movable across the ice surface, comprising: a receiver for detecting the light beam and determining a substantially vertical position along the receiver where the light beam impinges it; a support mount for maintaining the receiver at a constant height above the ice surface during ice resurfacing operations; an adjustable scraper blade for removing a depth of ice from the ice surface; a mast pole having a top end for supporting the receiver and a bottom end secured to the scraper blade; and a processor operatively coupled to the receiver and the scraper blade for determining the depth of ice to be removed based on the position along the receiver where the light beam impinges it and the level of the desired horizontal plane and for adjusting the scraper blade to remove ice to the depth determined.

Accordingly the specification and the embodiments disclosed therein are to be considered examples only, with a true scope and spirit of the disclosure being disclosed by the following numbered claims:

What is claimed is:

1. A support mount on an ice resurfacing machine for maintaining an ice surface level with a desired horizontal plane, the ice resurfacing machine moveable across the ice surface and comprising:

a receiver for detecting a light beam emitted along a plane parallel to the desired horizontal plane and for determining a substantially vertical position along the receiver where the light beam impinges it; and an adjustable scraper blade for removing a depth of ice from the ice surface; and a processor operatively coupled to the receiver and the scraper blade, for determining the depth of ice to be removed, based on the position along the receiver where the light beam impinges it and the level of the desired horizontal plane and for adjusting the scraper blade to remove ice to the depth determined; and the support mount comprising a mast pole having a top end for supporting the receiver and a bottom end connected to the scraper blade wherein the mast pole is retractable within the support mount to move the receiver from an operative position, when the receiver is maintained at a constant height above the ice surface during ice resurfacing operations, to a transport position, when no ice resurfacing operations are being performed, and extendable from the transport position to the operative position; and wherein the ice scraper is part of a conditioner and the height of the receiver above the top of the conditioner is maintained constant while in the operative position.

2. The support mount according to claim 1, wherein the top end of the mast pole magnetically engages the receiver.

3. The support mount according to claim 1, comprising a structure secured to the ice resurfacing machine having an internal bore for accepting the bottom end of the mast pole therewithin.

4. The support mount according to claim 1, wherein the mast pole is hydraulically retracted and extended to move the receiver between the operative and transport positions.

5. The support mount according to claim 1 wherein the mast pole is retracted while the scraping blade is substantially simultaneously raised away from the ice surface and the mast pole is extended while the scraping blade is substantially simultaneously lowered to the ice surface.

6. The support mount according to claim 1, wherein at all times while in the operative position the mast pole remains away from contact with the ice surface.

7. The support mount according to claim 2, wherein at all times while in the operative position the mast pole remains away from contact with the ice surface.

8. The support mount according to claim 3, wherein at all times while in the operative position the mast pole remains away from contact with the ice surface.

9. The support mount according to claim 1, wherein at all times while in the operative position the mast pole remains away from contact with the ice surface.

10. The support mount according to claim 4, wherein at all times while in the operative position the mast pole remains away from contact with the ice surface.

11. The support mount according to claim 7, wherein at all times while in the operative position the mast pole remains away from contact with the ice surface.

12. An ice resurfacing machine moveable across an ice surface for maintaining the ice surface level with a desired horizontal plane, comprising:

a receiver for detecting a light beam emitted along a plane parallel to the desired horizontal plane and for determining a substantially vertical position along the receiver where the light beam impinges it;

an adjustable scraper blade for removing a depth of ice from the ice surface;

a processor operatively coupled to the receiver and the scraper blade for determining the depth of ice to be removed based on the position along the receiver where the light beam impinges it and the level of the desired horizontal plane and for adjusting the scraper blade to remove ice to the depth determined;

the support mount comprising a mast pole having a top end for supporting the receiver and a bottom end connected to the scraper blade;

a support mount comprising a mast pole that is retractable within the support mount to move the receiver from an operative position, when the receiver is maintained at a constant height above the ice surface during ice resurfacing operations, to a transport position, when no ice resurfacing operations are being performed, and extendable from the transport position to the operative position; and wherein the scraper blade is part of a conditioner and the height of the receiver above the top of the conditioner is maintained constant while in the operative position.

13. The ice resurfacing machine according to claim 12, wherein the receiver is a laser receiver.

14. The ice resurfacing machine according to claim 12, wherein the receiver is operatively coupled to the processor by at least one cable.

15. The ice resurfacing machine according to claim 12, wherein the receiver communicates to the processor, information corresponding to the substantially vertical position along the receiver where the light beam impinges it.

16. The ice resurfacing machine according to claim 12, wherein the conditioner houses and secures the scraper blade thereto.

17. The ice resurfacing machine according to claim 12, wherein the conditioner defines an enclosure having at least one cover a fixed distance above appoint of contact between the conditioner and the ice surface, wherein the mast pole is secured at its bottom end to the conditioner.

18. The ice resurfacing machine according to claim 12, wherein the processor is operatively coupled to the scraper blade by a blade drive for adjusting a cutting depth of the scraper blade to the depth determined based on the position along the receiver where the light beam impinges it and at least one ice resurfacing parameter.

19. A system for maintaining an ice surface level with a desired horizontal plane comprising:

a transmitter for emitting a light beam along a plane parallel to the desired plane; and an ice resurfacing machine moveable across the ice surface, comprising:

a receiver for detecting a light beam emitted along a plane parallel to the desired horizontal plane and for determining a substantially vertical position along the receiver where the light beam impinges it;

an adjustable scraper blade for removing a depth of ice from the ice surface;

a processor operatively coupled to the receiver and the scraper blade for determining the depth of ice to be removed based on the position along the receiver where the light beam impinges it and the level of the desired horizontal plane and for adjusting the scraper blade to remove ice to the depth determined;

the support mount comprising a mast pole having a top end for supporting the receiver and a bottom end connected to the scraper blade;

a support mount comprising a mast pole that is retractable within the support mount to move the receiver from an operative position, when the receiver is maintained at a constant height above the ice surface during ice resurfacing operations, to a transport position, when no ice resurfacing operations are being performed, and extendable from the transport position to the operative position; and wherein the scraper blade is part of a conditioner and the height of the receiver above the top of the conditioner is maintained constant while in the operative position.

20. The system according to claim 19, wherein the transmitter is a laser transmitter.

21. The system according to claim 19, wherein the transmitter is configured to emit the light beam across a field of view that substantially covers the ice surface.

* * * * *